US006038866A

United States Patent [19]

Okamoto et al.

[11] Patent Number: 6,038,866

[45] Date of Patent: Mar. 21, 2000

[54] CRYOGENIC REFRIGERATING MACHINE AND CONTROL METHOD THEREFOR

[75] Inventors: Masakazu Okamoto; Toshiyuki Kurihara, both of Osaka, Japan

[73] Assignee: Daikin Industries, Ltd., Osaka, Japan

[21] Appl. No.: 09/068,020

[22] PCT Filed: Sep. 5, 1997

[86] PCT No.: PCT/JP97/03145

§ 371 Date: May 4, 1998

§ 102(e) Date: May 4, 1998

[87] PCT Pub. No.: WO98/11394

PCT Pub. Date: Mar. 19, 1998

[30] Foreign Application Priority Data

Sep. 13, 1996 [JP] Japan ..... 8-242866

[51] Int. Cl.[7] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,625,015 | 12/1971 | Chellis . | |
| 4,310,337 | 1/1982 | Sarcia . | |
| 4,397,155 | 8/1983 | Davey | 62/6 |
| 4,478,046 | 10/1984 | Saito et al. . | |
| 4,543,793 | 10/1985 | Chellis et al. | 62/6 |
| 4,761,963 | 8/1988 | Kiese | 62/6 |
| 4,794,752 | 1/1989 | Redderson . | |
| 5,032,772 | 7/1991 | Gully et al. | 62/6 |
| 5,088,288 | 2/1992 | Katagishi et al. | 62/6 |
| 5,245,830 | 9/1993 | Aubrun et al. | 62/6 |
| 5,361,588 | 11/1994 | Asami et al. . | |

FOREIGN PATENT DOCUMENTS

| | | |
|---|---|---|
| 46-10255 | 3/1971 | Japan . |
| 63-21451 | 1/1988 | Japan . |
| 6-101917 | 4/1994 | Japan . |
| 6-300378 | 10/1994 | Japan . |
| 7-35070 | 2/1995 | Japan . |

*Primary Examiner*—Ronald Capossela
*Attorney, Agent, or Firm*—Sixbey, Friedman, Leedom & Ferguson, PC; Eric J. Robinson; Donald R. Studebaker

[57] ABSTRACT

In a gas pressure-driven type cryogenic refrigerating machine, an inner space of a cylinder 2 is divided into a lower pressure room 20, an upper pressure room 29 and expansion rooms 30, 31 by a slack piston 17 and a displacer 22 connected to the slack piston, a rotary valve 35 alternately changes between a high-pressure valve-open position for supplying high-pressure helium gas to the upper pressure room 29 and the expansion rooms 30, 31 and a low-pressure valve-open position for discharging the helium gas in the upper pressure room 29 and the expansion rooms 30, 31, and a difference in gas pressures between the upper and lower pressure rooms 29, 30 causes the slack piston 17 to be driven to reciprocate the displacer 22 thereby producing a cold condition at an extremely low temperature level. In the cryogenic refrigerating machine, a time ratio of the low-pressure valve-open position of the rotary valve 35 for discharging the helium gas in the expansion rooms 30, 31 is set at 55 to 65% so as to be larger than a time ratio of the high-pressure valve-open position for supplying the high-pressure helium gas to the expansion rooms 30, 31 in the cylinder 2. This provides an increased capacity of the refrigerating machine.

5 Claims, 5 Drawing Sheets

CRYOGENIC REFRIGERATING MACHINE AND CONTROL METHOD THEREFOR

TECHNICAL FIELD

This invention relates to a cryogenic refrigerating machine for expanding working gas such as helium gas by the reciprocation of a displacer to produce a cold condition at an extremely low temperature level, relates to a control method for the cryogenic refrigerating machine, and particularly relates to a technical field for increasing the capacity of the refrigerating machine.

BACKGROUND ART

Conventionally, as a cryogenic refrigerating machine of such kind, there is well known a GM (Gifford-McMahon) refrigerating machine in which a displacer for forming an expansion space in a cylinder is provided and the reciprocation of the displacer expands high-pressure working gas supplied to the expansion space to produce a cold condition at an extremely low temperature level and discharges expanded low-pressure working gas from the expansion space to the outside of the cylinder.

Further, for example, Japanese Patent Application Laid-Open Gazette No. 6-300378 discloses a machine-driven type GM refrigerating machine in which a displacer is connected to a motor through a crank shaft and is reciprocated by the activation of the motor. In this refrigerating machine, there is proposed a technique that a valve body, which makes sliding contact with a valve plate rotating together with the crank shaft as a single piece and makes the valve plate open and closed, is configured to be rotatable from the outside and that by changing a position of the valve body relative to the valve plate, timing for supplying high-pressure working gas to the expansion space of the cylinder and timing for discharging low-pressure working gas expanded in the expansion space are variable in association with each other.

Furthermore, there is also known a gas pressure-driven type (improved Solvay type) GM refrigerating machine in which an intermediate-pressure room set at an intermediate pressure between high and low pressures is formed in a cylinder and a piston is reciprocated together with a displacer by a difference in gas pressures between the intermediate-pressure room and an expansion space.

Since the above-described gas pressure-driven type GM refrigerating machine drives the displacer by the gas pressure difference, in order to achieve a smooth operation of the displacer, the refrigerating machine is generally configured such that a high-pressure valve-open position for supplying high-pressure working gas to the expansion space in the cylinder and a low-pressure valve-open position for discharging the working gas in the expansion space substantially have the same time ratio (approximately 50%) in one reciprocation cycle of the displacer.

However, from a study of the capacity of the above-described refrigerating machine, the inventors have found, in terms of increase in the refrigerating capacity, that it is not necessarily required that the time ratio is substantially equalized between the high-pressure valve-open position and the low-pressure valve-open position and that it prevents increase in the refrigerating capacity instead.

Accordingly, an object of the present invention is, in a cryogenic refrigerating machine for producing a cold condition at an extremely low temperature level by the reciprocation of a displacer as described above, to provide an increased capacity of the cryogenic refrigerating machine by appropriately changing a time ratio of a low-pressure valve-open position for discharging working gas in an expansion space of a cylinder.

DISCLOSURE OF THE INVENTION

To attain the above object, in this invention, a time ratio of discharging low-pressure working gas in one reciprocation cycle of the displacer is set larger than a time ratio of supplying high-pressure working gas or larger than a ½ reciprocation cycle of the displacer.

More specifically, as shown in FIGS. 1 and 2, this invention premises a cryogenic refrigerating machine including a displacer (22) for dividing an inner space of a cylinder (2) into plural expansion spaces (29) to (31), the displacer (22) reciprocating to expand high-pressure working gas supplied to the expansion spaces (29) to (31) and discharge the expanded low-pressure working gas from the expansion spaces (29) to (31) to the outside of the cylinder (2), thereby producing a cold condition at an extremely low temperature level. Further, a time ratio of discharging the low-pressure working gas in one reciprocation cycle of the displacer (22) is set larger than a time ratio of supplying the high-pressure working gas in the same reciprocation cycle.

Under the arrangement, since the time ratio of discharging the low-pressure working gas in one reciprocation cycle of the displacer (22) is larger than the time ratio of supplying the high-pressure working gas in the same reciprocation cycle, a flow rate of working gas can be reduced at the discharge of the low-pressure working gas larger in pressure loss than at the supply of the high-pressure working gas. This leads to reduction in pressure loss as a whole thereby increasing efficiency. Further, since the expansion time of working gas in expansion rooms (30), (31) of the expansion spaces (29) to (31) becomes longer, the temperature in the cylinder can be decreased. This increases the capacity of the refrigerating machine in correspondence with the decrease in temperature.

In the cryogenic refrigerating machine having the above-described premise, valve means (35) that alternately changes between a high-pressure valve-open position for supplying the high-pressure working gas to the expansion spaces (29) to (31) in the cylinder (2) and a low-pressure valve-open open position for discharging the working gas in the expansion spaces (29) to (31) may be provided, and a time ratio of the low-pressure valve-open position of the valve means (35) may be set larger than a time ratio of the high-pressure valve-open position of the valve means (35). In this manner, when the time ratio of the low-pressure valve-open position of the valve means (35) is larger than the time ratio of the high-pressure valve-open position, the same operation and effects as described above can be obtained.

Further, in the cryogenic refrigerating machine having the above-described premise, a time ratio of discharging the low-pressure working gas in one reciprocation cycle of the displacer (22) may be set larger than a ½ reciprocation cycle of the displacer (22). Also in this manner, the same operation and effects can be obtained.

Furthermore, an intermediate-pressure room (8) set at an intermediate pressure between a high pressure and a low pressure of the working gas may be provided and the displacer (22) may be configured to reciprocate by a difference in gas pressures between a pressure room (20) communicating with the intermediate-pressure room (8) and a pressure room (29) of the expansion spaces (29) to (31).

In the gas pressure-driven type cryogenic refrigerating machine having the above arrangement, since the time ratio of discharging the low-pressure working gas in one reciprocation cycle of the displacer (22) is larger than the time ratio of supplying the high-pressure working gas in the same reciprocation cycle, the pressure of the intermediate-pressure room (8) is decreased to relatively approach the low-pressure side rather than the high-pressure side of the working gas. As a result, at the supply of the high-pressure working gas, a pressure difference between the pressure room (29) of the expansion spaces (29) to (31) and the pressure room (20) communicating with the intermediate-pressure room (8) is increased so that the increased pressure difference causes the displacer (22) to promptly move. On the contrary, at the discharge of the low-pressure working gas, a pressure difference between both the pressure rooms (20), (29) is decreased so that the moving speed of the displacer (22) becomes smaller than at the supply of the high-pressure working gas. This increases the capacity of the gas pressure-driven type cryogenic refrigerating machine because of the same reason as described above.

Further, the time ratio of the low-pressure valve-open position of the valve means (35) may be 55 to 65% of the whole time of both the valve-open positions while the time ratio of the high-pressure valve-open position may be 45 to 35%. This provides an optimum range of the time ratio of the low-pressure valve-open position.

Furthermore, in a method of controlling the above-premised cryogenic refrigerating machine, a time ratio of discharging the low-pressure working gas in one reciprocation cycle of the displacer (22) may be set larger than a time ratio of supplying the high-pressure working gas in the same reciprocation cycle. Also in this method, the same operation and effects can be obtained.

BEST MODE FOR CARRYING OUT THE INVENTION

Figure 2:
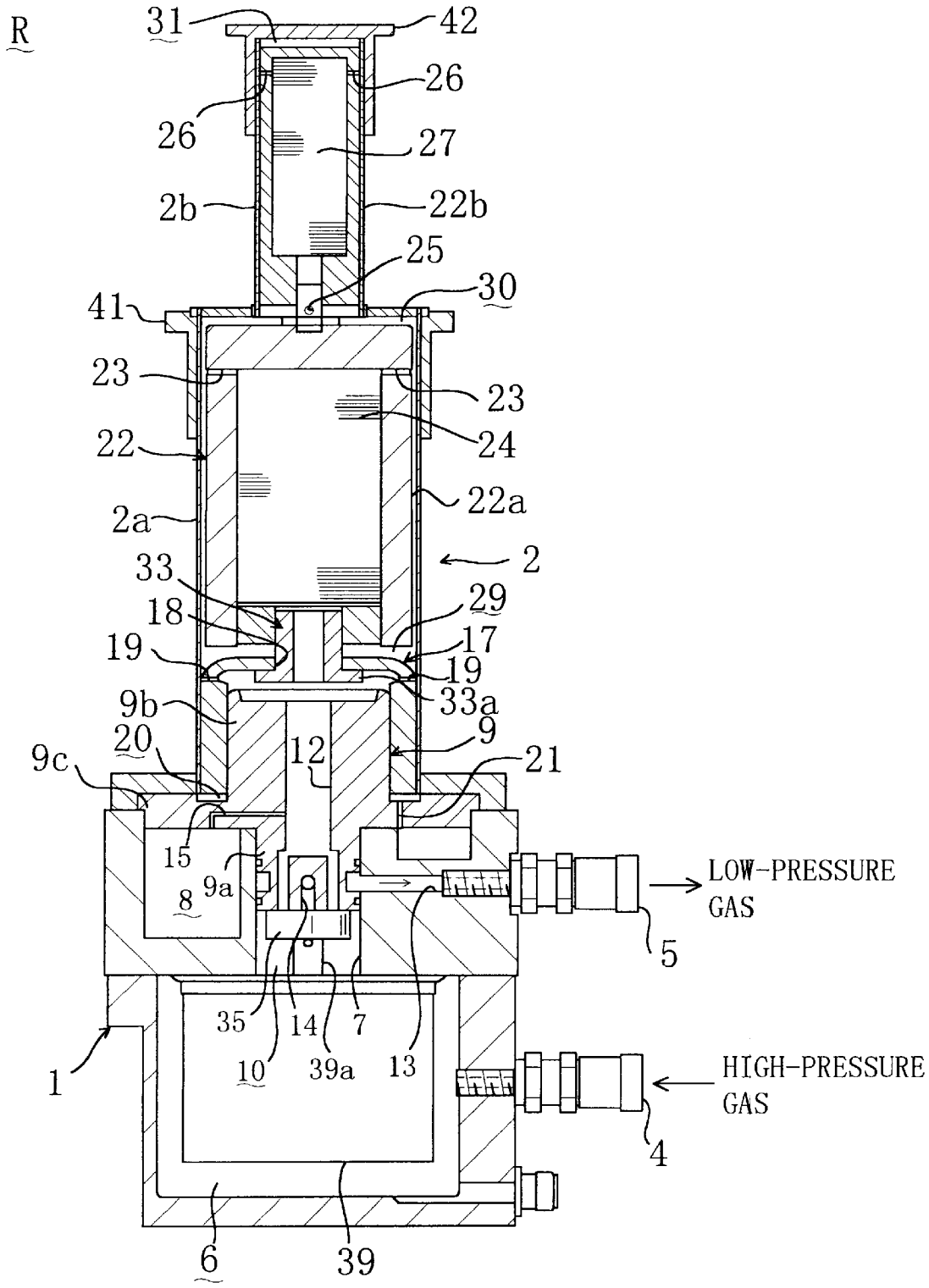
FIG. 2 is a cross section showing the entire structure of a cryogenic refrigerating machine according to an embodiment of the present invention.

FIG. 2 shows the entire structure of a cryogenic refrigerating machine (R) according to an embodiment of the invention. The cryogenic refrigerating machine (R) is formed of an expansion machine having a gas pressure-driven type GM cycle (Gifford-McMahon cycle) that reciprocates a displacer (22) in a cylinder (2) by pressure of helium gas (working gas) as described later to expand high-pressure helium gas.

More specifically, the cryogenic refrigerating machine (R) includes an enclosed motor head (1) and the cylinder (2) which is hermetically provided in contiguous with the top surface of the motor head (1) and which has a two-stage structure formed of a lower large-diameter part (2*a*) and an upper small-diameter part (2*b*). In the side surface of the motor head (1), a high-pressure gas inlet (4) and a low-pressure gas outlet (5) located above the high-pressure gas inlet (4) are formed. The high-pressure gas inlet (4) is connected to a discharge side of an unshown compressor through a high-pressure pipe. The low-pressure gas outlet (5) is connected to a suction side of the compressor through a low-pressure pipe.

Inside of the motor head (1), a motor room (6) communicating with the high-pressure gas inlet (4), a fitting hole (7) located above the motor room (6) and formed of a vertical through hole in which an inner space communicates at a lower end thereof with the motor room (6), and an intermediate-pressure room (8) formed of a substantially annular space located around the fitting hole (7) are formed.

Into the boundary between the motor head (1) and the cylinder (2), a valve stem (9) forming a member of blocking the bottom end (base end) of the cylinder (2) is inserted. The valve stem (9) includes: a valve sheet (9*a*) hermetically fitted into the fitting hole (7); a piston support (9*b*) which is formed in a diameter smaller than the inner diameter of the large-diameter part (2*a*) of the cylinder (2) and concentrically protrudes to a lower part of the inner space of the cylinder large-diameter part (2*a*); and a flange (9*a*) forming the top wall of the intermediate-pressure room (8). A space surrounded by the bottom surface of the valve sheet (9*a*) and the side wall of the fitting hole (7) forms a valve room (10) communicating with the high-pressure gas inlet (4) through the motor room (6).

Figure 4:
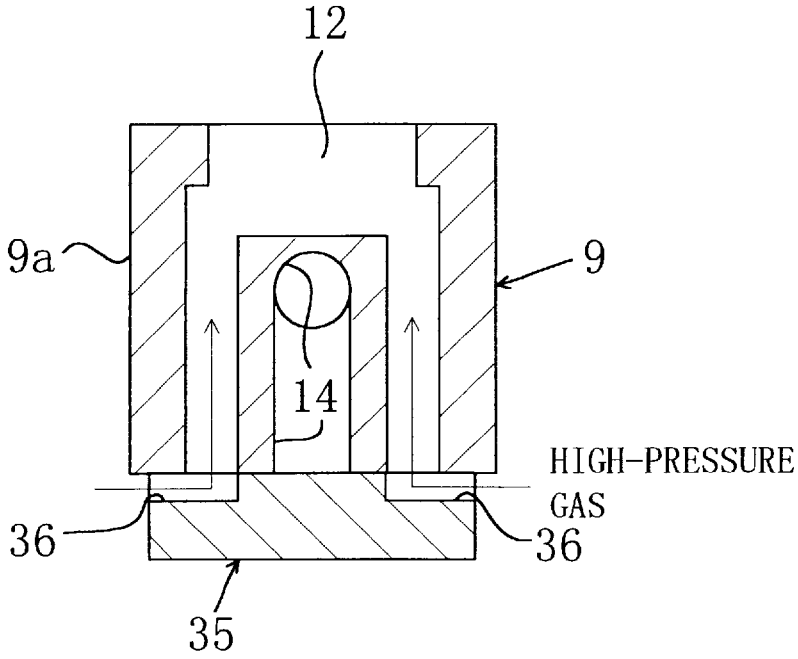
FIG. 4 is an enlarged cross section showing the high-pressure valve-open position of the rotary valve.
Figure 5:
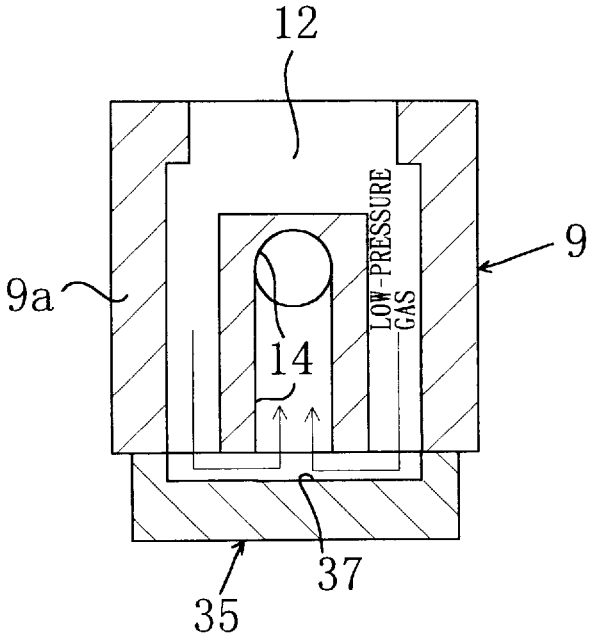
FIG. 5 is an enlarged cross section showing the low-pressure valve-open position of the rotary valve.

In the valve stem (9), also as shown in FIGS. 4 and 5, a first gas flow passage (12) and a second gas flow passage (14) are formed so as to pass through the valve stem (9). The first gas flow passage (12) is branched at a lower half part into two ways and communicates the valve room (10) with the inner space of the cylinder (2). The second gas flow passage (14) communicates at one end thereof with the first gas flow passage (12) through the below-described low-pressure port (37) of a rotary valve (35) and communicates at the other end to the low-pressure gas outlet (5) through a connecting passage (13) formed in the motor head (1). The first gas flow passage (12) is communicated at some mid-point thereof with the intermediate-pressure room (8) through a capillary tube (15) at all times. In the bottom surface of the valve sheet (9*a*) of the valve stem (9) which faces the valve room (10), the second gas flow passage (14) is open at the center of the valve stem (9) and both the branched first gas passages (12), (12) are respectively open in symmetrical positions with respect to the second gas flow passage (14).

In a lower part of the large-diameter part (2*a*) of the cylinder (2), an approximately inverted cup-shaped slack piston (17) having a bottom wall is reciprocatably fitted onto the piston support (9*b*) of the valve stem (9) in a state that the inner surface is slidably guided on the piston support (9*b*). The slack piston (17) forms an upper space in the cylinder (2) into an upper pressure room (29) and forms a lower end space in the cylinder (2) into a lower pressure room (20). The lower pressure room (20) is communicated with the intermediate-pressure room (8) of the motor head (1) through an orifice (21) at all times. Accordingly, the lower pressure room (20) is set at an intermediate pressure between high pressure and low pressure of helium gas. A difference in gas pressures between the lower pressure room (20) and the upper pressure room (29) allows the slack piston (17) to reciprocate together with the displacer (22). A large-diameter center hole (18) is formed through the center of the bottom wall of the slack piston (17). Along a circular corner of the piston (17), a plurality of connecting holes (19), (19), . . . communicating the inside and outside of the piston (17) are formed.

The displacer (22) is reciprocatably fitted into the cylinder (2). The displacer (22) is composed of: an enclosed, cylindrical large-diameter part (22*a*) which slides in a substantially upper half of the large-diameter part (2*a*) of the cylinder (2); and an enclosed, cylindrical small-diameter part (22*b*) which is coupled to the top end of the large-diameter part (22*a*) so as to move together and slides in the small-diameter part (2*b*) of the cylinder (2). The displacer (22) forms the expansion spaces (29) to (31) of the cylinder (2) located above the slack piston (17) into the upper pressure room (29), a first-stage expansion room (30) and a second-stage expansion room (31) in the order from the lowest, respectively. An inner space of the large-diameter part (22*a*) of the displacer (22) is communicated with the first-stage expansion room (30) through a connecting hole (23) at all times. A first-stage regenerator (24) made of a regenerative heat exchanger is inserted into the inner space of the large-diameter part (22*a*). An inner space of the small-diameter part (22*b*) of the displacer (22) is communicated at all times with the first-stage expansion room (30) and the second-stage expansion room (31) through a connecting hole (25) and a connecting hole (26), respectively. A second-stage regenerator (27) of the same type used for the first-stage regenerator (24) is inserted into the inner space of the displacer small-diameter part (22*b*).

At the bottom end of the large-diameter part (22*a*) of the displacer (22), a tubular engaging piece (33) is projectingly provided integrally with the large-diameter part (22*a*) so as to communicate the inner space of the large-diameter part (22*a*) with the upper pressure room (29). A lower part of the engaging piece (33) comes through the center hole (18) of the bottom wall of the slack piston (17) and extends to the inside of the piston (17) by a specified dimension. At the bottom end of the engaging piece (33), a flange-shaped engaging part (33*a*) which engages with the bottom wall of the piston (17) is formed integrally with the engaging piece (33). The displacer (22) is configured such that in the case where the slack piston (17) moves upward, the top surface of the bottom wall of the piston (17) comes into contact with the bottom surface of the displacer (22) at the instant when the piston (17) has moved upward by a specified stroke so that the displacer (22) is driven by the piston (17) to start to move upward, and such that in the case where the slack piston (17) moves downward, the bottom surface of the bottom wall of the piston (17) is engaged with the engaging part (33*a*) of the engaging piece (33) at the instant when the piston (17) has moved downward by a specified stroke so that the displacer (22) is driven by the piston (17) to start to move downward. In other words, the displacer (22) is configured so as to move following the piston (17) with a delay corresponding to the specified stroke.

Further, in the valve room (10) of the motor head (1), a rotary valve (35) is disposed as a valve means alternately changing between a high-pressure valve-open position for supplying high-pressure helium gas to the upper pressure room (29) and the expansion rooms (30), (31) which are expansion spaces in the cylinder (2) and a low-pressure valve-open position for discharging the helium gas in the upper pressure room (29) and the expansion rooms (30), (31). The rotary valve (35) is driven in rotation by a valve motor (39) placed in the motor room (6). Through the change of position of the rotary valve (35), the high-pressure gas inlet (4), or the valve room (10) communicating with the high-pressure gas inlet (4), and the low-pressure gas outlet (5), or the connecting passage (13) communicating with the low-pressure gas outlet (5), are alternately communicated with the upper pressure room (29) and the first-stage and second-stage expansion rooms (30), (31).

Specifically, an output shaft (39*a*) of the valve motor (39) is engaged with the center of the bottom surface of the rotary valve (35) so as to be rotatable together with the rotary valve (35). A spring (not shown) is compressively interposed between the bottom surface of the valve (35) and the motor (39). By the action of the resilient force of the spring and the pressure of the high-pressure helium gas in the valve room (10), the top surface of the rotary valve (35) is pushed against the bottom surface of the valve sheet (9*a*) of the valve stem (9) at a constant pressing force.

Figure 3:
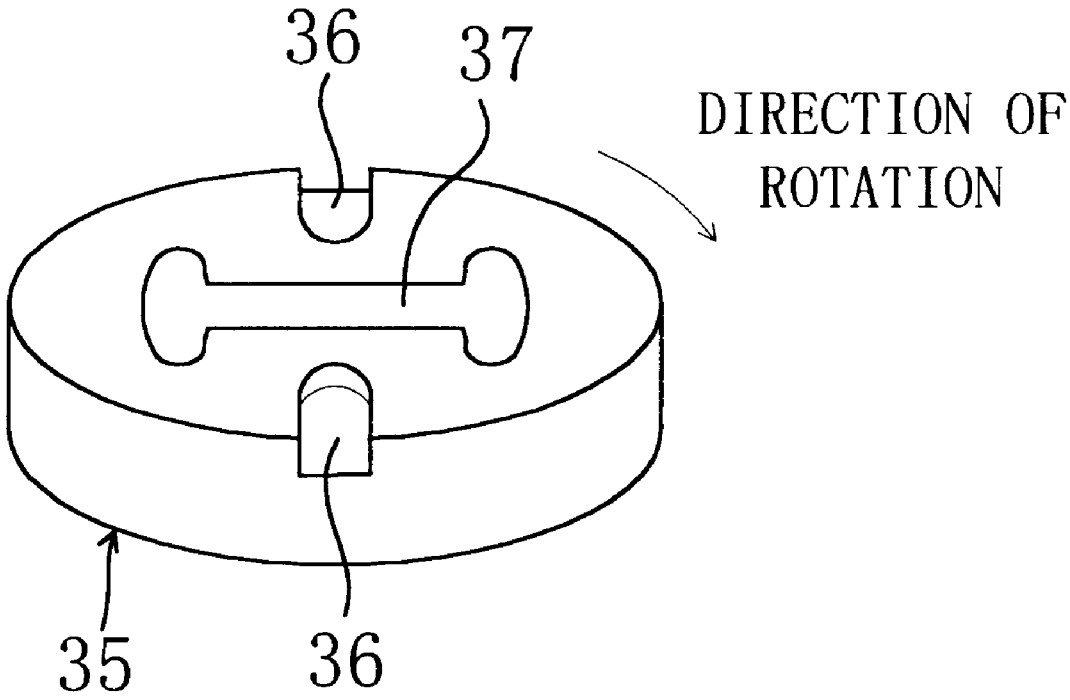
FIG. 3 is an enlarged perspective view of the rotary valve.

As shown in FIG. 3, the rotary valve (35) is provided at the top surface thereof with: a pair of high-pressure ports (36), (36), formed in a manner that the top surface is cut by specified lengths from radially opposed parts of the outer peripheral edge toward the center; and a low-pressure port (37), which is disposed with an angular space of about 90 degrees left in a direction of rotation of the rotary valve (35) (a direction shown in an arrow in FIG. 3) with respect to the high-pressure ports (36), (36) and is formed in a groove having both ends in a manner that the top surface of the valve (35) is cut in a diametric direction from the center to the vicinity of the outer peripheral edge. By driving the valve motor (39), the rotary valve (35) is rotated with the top surface thereof in pressure contact with the bottom surface of the valve stem (9) so as to be changed between an open position and a closed position. The change of position of the rotary valve (35) causes a pressure difference between the upper pressure room (29) and the lower pressure room (20) and the pressure difference allows the slack piston (17) and the displacer (22) to reciprocate in the cylinder (2). Specifically, as shown in FIG. 4, when the rotary valve (35) is rotated so that respective internal ends of both the high-pressure ports (36), (36), located on the top surface of the rotary valve (35), meet respective two open ends of the first gas flow passage (12) which are open in the bottom surface of the valve sheet (9*a*) of the valve stem (9), the valve room (10) (the high-pressure gas inlet (4)) is brought into communication with the upper pressure room (29) and the first-stage and second-stage expansion rooms (30), (31) through the high-pressure ports (36), (36) and the first gas flow passage (12). As a result, high-pressure helium gas is introduced into the respective rooms (29), (30), (31) and a difference in gas pressures between the high-pressure upper pressure room (29) and the lower pressure room (20) causes the slack piston (17) to move downward together with the displacer (22). On the other hand, as shown in FIG. 5, when both the external ends of the low-pressure port (37), which always communicates at a middle part thereof with the second gas flow passage (14) having an opening in the bottom surface of the valve sheet (9*a*), meet both the open ends of the first gas flow passage (12), each of the rooms (29) to (31) of the cylinder (2) is brought into communication with the low-pressure gas outlet (5) through the first gas flow passage (12), the low-pressure port (37), the second gas flow passage (14) and the connecting passage (13) so that helium gas included in the rooms (29) to (31) is discharged from the low-pressure gas outlet (5) while being expanded. Further, a difference in gas pressures between the low-pressure upper pressure room (29) and the lower pressure room (20) causes the slack piston (17) to move upward together with the displacer (22). By the upward movement of the displacer (22), the helium gas is subjected to Simon expansion and the decrease in temperature with the expansion produces a cold condition at an extremely low temperature level. The cold condition keeps a first heat station (41), located at the tip end (top end) of the large-diameter part (2*a*) of the cylinder (2) and associated with the first-stage expansion room (30), at a specified temperature level, and keeps a second heat station (42), located at the tip end (top end) of the small-diameter part (2*b*) of the cylinder (2), at a temperature level lower than that of the first heat station (41).

Figure 1:
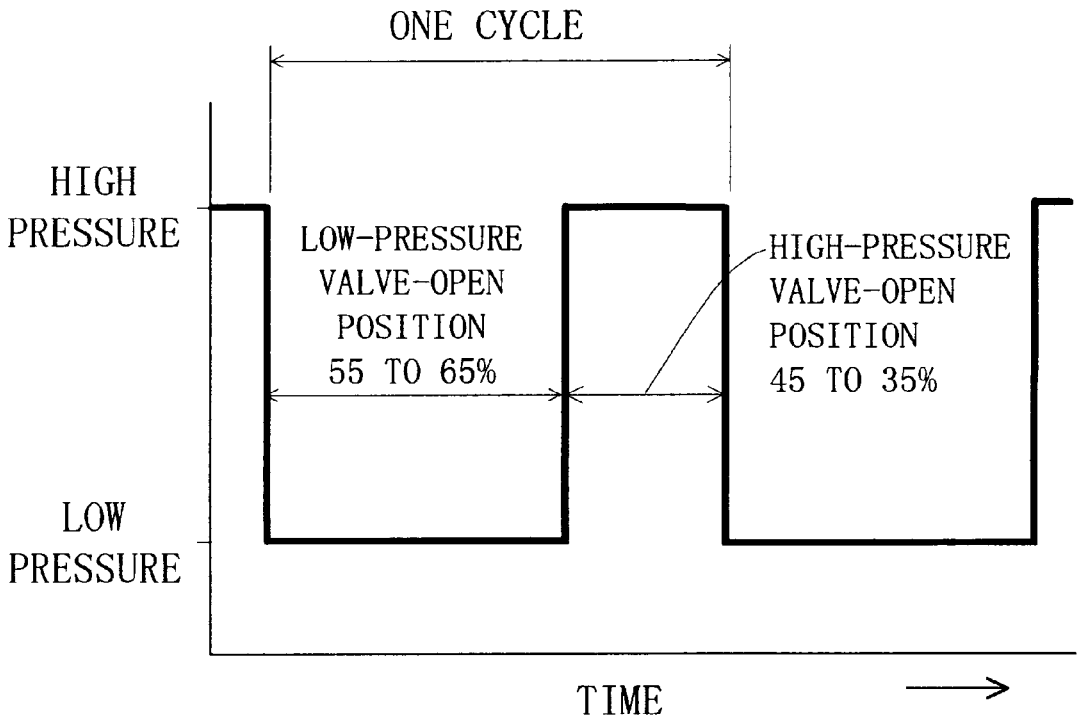
FIG. 1 is a graph showing both time ratios of a low-pressure valve-open position and a high-pressure valve-open position of a rotary valve in one reciprocation cycle of a displacer.

As a feature of the present invention, a time ratio of discharging the low-pressure helium gas in one reciprocation cycle of the displacer (22) is larger than a time ratio of supplying the high-pressure helium gas. Specifically, as shown in FIG. 1, a time ratio of the low-pressure valve-open position of the rotary valve (35) is set larger than a time ratio of the high-pressure valve-open position of the same. For example, the time ratio of the low-pressure valve-open position with respect to the whole opening time of the valve (35) is 55 to 65% while the remaining time ratio of the high-pressure valve-open position is 45 to 35%. Thus, the time ratio of discharging the low-pressure helium gas in one reciprocation cycle of the displacer (22) is set larger than a ½ reciprocation cycle of the displacer (22). The change in the time ratio of the low-pressure valve-open position of the rotary valve (35) can be achieved by changing the form, the size, the position or the like of the high-pressure port (36) or the low-pressure port (37) of the rotary valve (35), by changing the form, the size, the position or the like of the gas passages (12), (14) of the valve stem (9), or by making the rotational speed per rotation of the rotary valve (35) variable.

Next, description will be made about effects of the above-described embodiment.

The operation of the above-described cryogenic refrigerating machine (R) is basically performed in the same manner as in the normal cryogenic refrigerating machine. More specifically, in conditions that the pressure of the cylinder (2) of the refrigerating machine (R) is low and the slack piston (17) and the displacer (22) are in their rising end positions, when the rotary valve (35) is rotated by driving the valve motor (39) so that the high-pressure ports (36), (36) of the rotary valve (35) meet both the open ends of the first gas flow passage (12) located in the bottom surface of the valve stem (9), the rotary valve (35) turns to the high-pressure valve-open position that the valve (35) is open to the high-pressure helium gas side. Thereby, normal-temperature high-pressure helium gas supplied to the valve room (10) through the high-pressure gas inlet (4) and the motor room (6) of the refrigerating machine (R) is introduced into the upper pressure room (29) located above the slack piston (17) through the high-pressure ports (36), (36) of the rotary valve (35) and the first gas flow passage (12), and is then sequentially introduced into the expansion rooms (30), (31) through the regenerators (24), (27) of the displacer (22). The helium gas is cooled by heat exchange during the passage of the regenerators (24), (27).

When the gas pressure of the upper pressure room (29) located above the slack piston (17) becomes higher than that of the lower pressure room (20) located below the slack piston (17), the pressure difference between both the pressure rooms (20), (29) causes the piston (17) to move downward. When a downward stroke of the piston (17) reaches a specified value, the bottom surface of the bottom wall of the piston (17) engages with the engaging part (33*a*) of the engaging piece (33) located at the bottom end of the displacer (22) so that the displacer (22) is moved downward by the piston (17) with a delay from the change in pressure. The downward movement of the displacer (22) causes the expansion rooms (30), (31) located thereabove to be further filled with high-pressure gas.

Thereafter, also after the rotary valve (35) is closed, the displacer (22) continues to move down by its inertial force so that helium gas in the upper pressure room (29) located above the displacer (22) moves toward the expansion rooms (30), (31).

After the displacer (22) reaches its lowest end position, the low-pressure port (37) of the rotary valve (35) meets the open end of the first gas flow passage (12) located in the bottom surface of the valve stem (9) so that the valve (35) turns to the low-pressure valve-open position that the valve (35) is open to the low-pressure helium gas side. With the opening of the valve, the helium gas in the expansion rooms (30), (31) located above the displacer (22) is subjected to Simon expansion. The decrease in temperature with the gas expansion cools the first heat station (41) to a specified temperature level and cools the second heat station (42) to a temperature level lower than that of the first heat station (41).

The helium gas having reached a low temperature in the expansion rooms (30), (31) returns to the inside of the upper pressure room (29) through the regenerators (24), (27) in the displacer (22) in reverse order to the above-described case of introducing the gas. During the time, the helium gas is heated to a normal temperature while cooling the regenerators (24), (27). The normal-temperature helium gas is discharged to the outside of the refrigerating machine (R) through the first gas flow passage (12), the low-pressure port (37) of the valve (35) and the connecting passage (13) together with the gas in the upper pressure room (29), passes through the low-pressure gas outlet (5) and is then sucked into the compressor. Through the discharge of the gas, the gas pressure of the upper pressure room (29) is decreased and the pressure difference between the upper pressure room (29) and the lower pressure room (20) causes the slack piston (17) to rise. Thereafter, the top surface of the bottom wall of the piston (17) comes into contact with the bottom surface of the displacer (22) and the displacer (22) is then pushed upward. The upward movement of the displacer (22) causes the gas in the expansion rooms (30), (31) to be further discharged to the outside of the refrigerating machine (R).

Subsequently, the rotary valve (35) is closed. Also after that, however, the displacer (22) continues to move upward to its rising end position and the gas in the expansion rooms (30), (31) continues to be discharged. Finally, the displacer (22) returns to an initial position. In this manner, one operating cycle of the displacer (22) is completed. After that, the same operation is repeated so that the temperatures of the heat stations (41), (42) are gradually decreased to their extremely low temperature level.

In this embodiment, since the time ratio of the low-pressure valve-open position of the rotary valve (35) in one reciprocation cycle of the displacer (22) is larger than the time ratio of the high-pressure valve-open position of the same (the time ratio of the low-pressure valve-open position is larger than a ½ reciprocation cycle of the displacer (22)), i.e., since the time ratio of the low-pressure valve-open position with respect to the whole opening time of the rotary valve (35) is 55 to 65% while the time ratio of the high-pressure valve-open position is 45 to 35%, the gas pressure of the intermediate-pressure room (8) communicating with the first gas flow passage (12) through the capillary tube (15) at all times and the gas pressure of the lower pressure room (20) communicating with the intermediate-pressure room (8) through the orifice (21) at all times are decreased together in correspondence with an increase in time of the low-pressure valve-open position. The gas pressure of the lower pressure room (20) relatively comes close to the low-pressure side in the range of gas pressures from the high-pressure helium gas to the low-pressure helium gas. Thereby, a difference in gas pressures between the upper pressure room (29) and the lower pressure room (20) at the supply of high-pressure helium gas becomes larger, whereas a difference in gas pressures between the upper pressure room (29) and the lower pressure room (20) at the discharge of low-pressure helium gas becomes smaller. Accordingly, in the high-pressure valve-open position of the rotary valve (35), the piston (17) promptly moves downward together with the displacer (22). On the other hand, in the low-pressure valve-open position, the moving speed of the displacer (22) becomes smaller than in the high-pressure valve-open position. As a result, such a difference in the moving speed of the displacer (22) or the like provides an increased capacity of the gas pressure-driven type cryogenic refrigerating machine (R).

In the above-described embodiment, the rotary valve (35) is changed to either the high-pressure valve-open position or the low-pressure valve-open position in one reciprocation cycle of the displacer (22). However, the rotary valve (35) may be changed to a valve-closed position for a given time between both the high-pressure and low-pressure valve-open positions.

The above embodiment describes an application to the gas pressure-driven type GM refrigerating machine (R) with the slack piston (17). The present invention may be applied to machine-driven type GM refrigerating machines which directly drive the displacer (22) into reciprocation.

Figure 6:
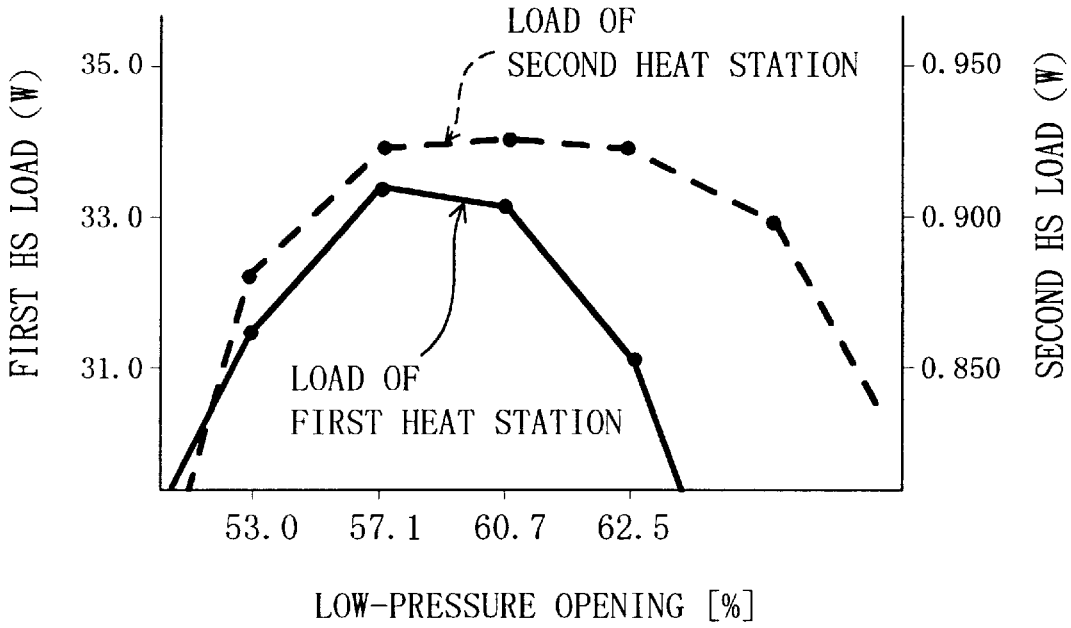
FIG. 6 is a graph showing changes in capacity with respect to refrigeration load when the time ratio of the low-pressure valve-open position is changed in a condition that the rotary valve is rotated at 107 rpm.
Figure 7:
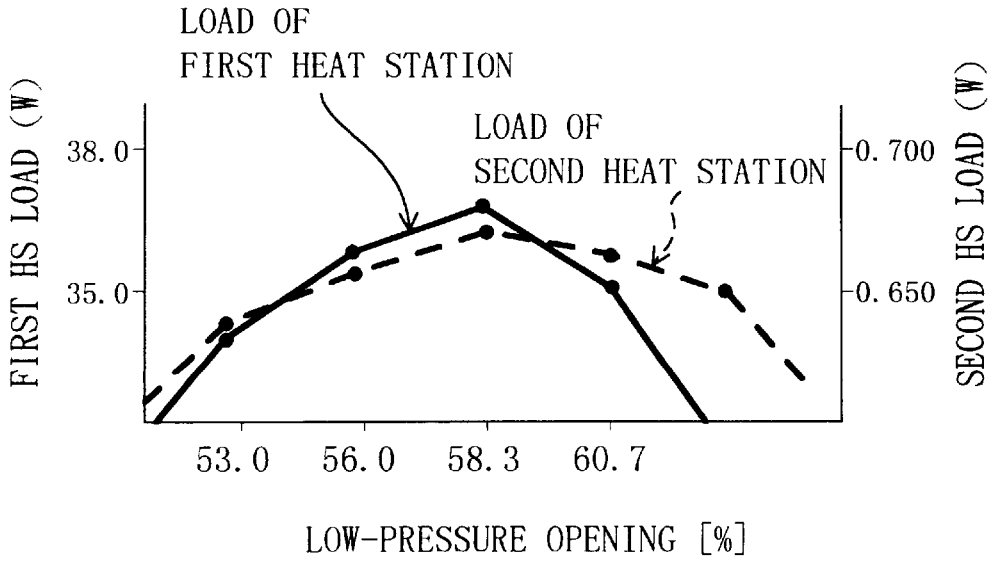
FIG. 7 is a graph showing changes in capacity in a condition that the rotary valve is rotated at 144 rpm, which corresponds to FIG. 6.

FIGS. 6 and 7 show results of concrete examples that the inventors have conducted. FIG. 6 shows changes in capacity with respect to refrigeration load in the first and second heat stations when the time ratio of the low-pressure valve-open position is changed to 50 to 70% (the time ratio of the high-pressure valve-open position is 50 to 30%) in a condition that the rotary valve is rotated at 107 rpm. FIG. 7 shows changes in capacity with respect to refrigeration load in the first and second heat stations when the time ratio of the low-pressure valve-open position is changed to 50 to 65% (the time ratio of the high-pressure valve-open position is 50 to 35%) in a condition that the rotary valve is rotated at 144 rpm. In either cases, the temperature of the first heat station was 35 K and the temperature of the second heat station was 4.2 K.

As is seen from FIGS. 6 and 7, as compared with the case that both the time ratio of the high-pressure valve-open position and the time ratio of the low-pressure valve-open position are 50%, an increased refrigerating capacity is obtained in the case that the time ratio of the low-pressure valve-open position is more than 50%. When the time ratio of the low-pressure valve-open position is 55 to 65% (when the time ratio of the high-pressure valve-open position is 45 to 35%), a good refrigerating capacity is obtained. When the time ratio of the low-pressure valve-open position is 58 to 62% (when the time ratio of the high-pressure valve-open position is 42 to 38%), a further excellent refrigerating capacity is obtained.

Industrial Applicability

This invention reduces gas pressure loss and enables a gas expansion time in an expansion space to be kept for a long time in a cryogenic refrigerating machine for obtaining a cold condition at an extremely low temperature level by the reciprocation of a displacer, and therefore, provides a high industrial applicability in a point that a largely increased capacity of the refrigerating machine can be expected.

We claim:

1. A cryogenic refrigerating machine comprising a displacer for dividing an inner space of a cylinder into plural expansion spaces, the displacer reciprocating to expand high-pressure working gas supplied to the expansion spaces and discharge the expanded low-pressure working gas from the expansion spaces to the outside of the cylinder, thereby producing a cold condition at an extremely low temperature level, an intermediate-pressure room set at an intermediate pressure between a high pressure and a low pressure of the working gas, with the displacer configured to reciprocate by a difference in gas pressures between a pressure room communicating with the intermediate-pressure room and a pressure room of the expansion spaces wherein a time period for discharging the low-pressure working gas in one reciprocation cycle of the displacer is set larger than a time period for supplying the high-pressure working gas in the same reciprocation cycle.

2. A cryogenic refrigerating machine comprising a displacer for dividing an inner space of a cylinder into plural expansion spaces, the displacer reciprocating to expand high-pressure working gas supplied to the expansion spaces and discharge the expanded low-pressure working gas from the expansion spaces to the outside of the cylinder, thereby producing a cold condition at an extremely low temperature level, an intermediate-pressure room set at an intermediate pressure between a high pressure and a low pressure of the working gas, with the displacer is configured to reciprocate by a difference in gas pressures between a pressure room communicating with the intermediate-pressure room and a pressure room of the expansion spaces; and valve means that alternately changes between a high-pressure valve-open position for supplying the high-pressure working gas to the expansion spaces in the cylinder and a low-pressure valve-open position for discharging the working gas in the expansion spaces to is provided, wherein a time period for the low-pressure valve-open position of the valve means is set larger than a time period for the high-pressure valve-open position of the valve means.

3. A cryogenic refrigerating machine according to claim 2, wherein the time period for the low-pressure valve-open position of the valve means is 55 to 65% of the whole time of both the valve-open positions, and the time period for the high-pressure valve-open position is 45 to 35%.

4. A cryogenic refrigerating machine comprising a displacer for dividing an inner space of a cylinder into plural expansion spaces, the displacer reciprocating to expand high-pressure working gas supplied to the expansion spaces and discharge the expanded low-pressure working gas from the expansion spaces to the outside of the cylinder, thereby producing a cold condition at an extremely low temperature level, an intermediate-pressure room set at an intermediate pressure between a high pressure and a low pressure of the working gas with the displacer is configured to reciprocate by a difference in gas pressures between a pressure room communicating with the intermediate-pressure room and a pressure room of the expansion spaces; wherein a time period for discharging the low-pressure working gas into one reciprocation cycle of the displacer is set larger than a ½ reciprocation cycle of the displacer.

5. A method of controlling a cryogenic refrigerating machine including a displacer for dividing an inner space of a cylinder into plural expansion spaces, comprising the steps of reciprocating the displacer to expand high-pressure working gas supplied to the expansion spaces and to discharge the expanded low-pressure working gas from the expansion spaces to the outside of the cylinder, thereby producing a cold condition at an extremely low temperature level, and setting a time period for discharging the low-pressure working gas in one reciprocation cycle of the displacer larger than a time period for supplying the high-pressure working gas in the same reciprocation cycle.

* * * * *